US008833087B2

(12) United States Patent
Rice et al.

(10) Patent No.: US 8,833,087 B2
(45) Date of Patent: Sep. 16, 2014

(54) FLOW SPLITTER FOR GAS TURBINE ENGINE

(75) Inventors: Edward Claude Rice, Indianapolis, IN (US); Stuart Bloom, Indianapolis, IN (US); John R. Louie, Mooresville, IN (US)

(73) Assignee: Rolls Royce Corporation, Indianapolis, IN (US)

( * ) Notice: Subject to any disclaimer, the term of this patent is extended or adjusted under 35 U.S.C. 154(b) by 1165 days.

(21) Appl. No.: 12/290,318

(22) Filed: Oct. 29, 2008

(65) Prior Publication Data

US 2010/0101230 A1 Apr. 29, 2010

(51) Int. Cl.
*F02C 7/20* (2006.01)
*F01D 9/06* (2006.01)
*F01D 9/04* (2006.01)

(52) U.S. Cl.
CPC .. *F01D 9/04* (2013.01); *F01D 9/06* (2013.01); *F01D 9/065* (2013.01)
USPC ..... 60/796; 60/797; 60/798; 60/799; 60/800; 60/751

(58) Field of Classification Search
USPC ..... 60/751, 796, 800, 798; 415/211.2
See application file for complete search history.

(56) References Cited

U.S. PATENT DOCUMENTS

| | | | | |
|---|---|---|---|---|
| 4,349,314 | A | 9/1982 | Erwin | |
| 5,077,967 | A | 1/1992 | Widener et al. | |
| 5,123,811 | A | 6/1992 | Kuroiwa | |
| 5,165,850 | A | 11/1992 | Humke et al. | |
| 5,236,301 | A | 8/1993 | Palmer | |
| 5,564,898 | A | 10/1996 | Richards et al. | |
| 5,592,821 | A * | 1/1997 | Alary et al. | 60/751 |
| 5,704,211 | A | 1/1998 | Hatfield | |
| 5,845,482 | A * | 12/1998 | Carscallen | 60/785 |
| 6,123,506 | A | 9/2000 | Brand et al. | |
| 6,280,139 | B1 | 8/2001 | Romani et al. | |
| 6,554,569 | B2 | 4/2003 | Decker et al. | |
| 6,651,439 | B2 * | 11/2003 | Al-Roub et al. | 60/772 |
| 7,025,566 | B2 | 4/2006 | Sasu et al. | |
| 7,618,232 | B2 * | 11/2009 | Bil et al. | 415/69 |

* cited by examiner

*Primary Examiner* — Craig Kim
(74) *Attorney, Agent, or Firm* — Krieg DeVault LLP

(57) ABSTRACT

A splitter is disclosed that can be coupled with a splitter support and used within a diffuser of a gas turbine engine. The splitter includes apertures for receiving a portion of the splitter support. The splitter support includes support arms that are adapted to be slidingly received within the apertures of the splitter.

19 Claims, 7 Drawing Sheets

FLOW SPLITTER FOR GAS TURBINE ENGINE

GOVERNMENT RIGHTS

The present application was made with the United States government support under Contract No. N00019-04-C-0102, awarded by the U.S. Navy. The United States government has certain rights in the present application.

FIELD OF THE INVENTION

The present invention generally relates to flow splitters, and more particularly, but not exclusively, to diffuser splitters.

BACKGROUND

In a gas turbine engine, working fluid is generally compressed by a compressor before being mixed with the working fluid and combusted within a combustor. Prior to entering the combustor, the working fluid can be split into multiple flow streams. Unfortunately, some existing systems have various shortcomings relative to certain applications. Accordingly, there remains a need for further contributions in this area of technology.

SUMMARY

One embodiment of the present invention is a unique flow splitter. Other embodiments include apparatuses, systems, devices, hardware, methods, and combinations for splitting a flow of working fluid into multiple flow streams. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
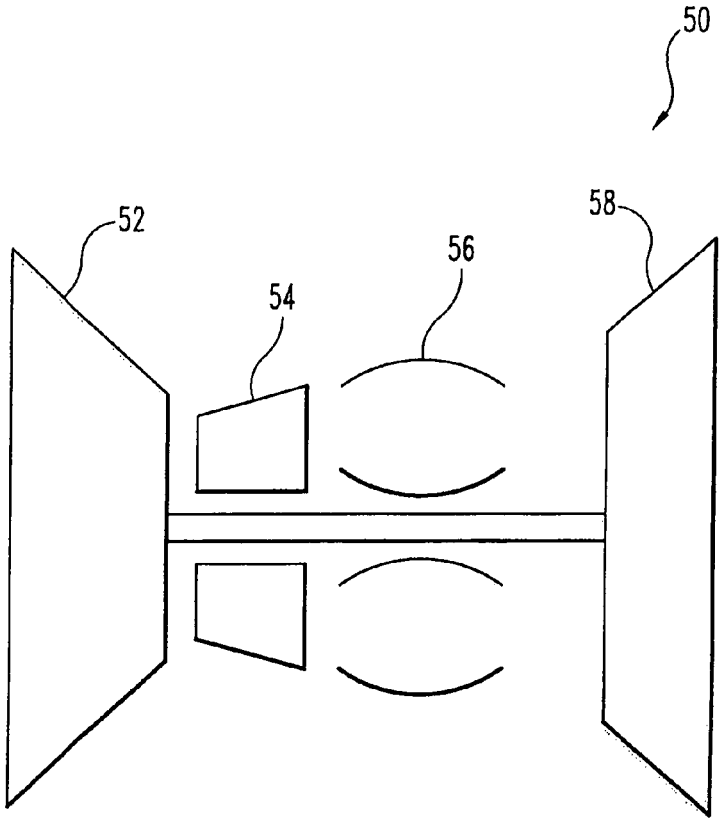
FIG. 1 is a schematic of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, a gas turbine engine 50 is shown having a compressor 52, a diffuser 54, a combustor 56, and a turbine 58, which together are used to provide an aircraft power plant. The term aircraft includes, but is not limited to, helicopters, airplanes, unmanned space vehicles, fixed wing vehicles, variable wing vehicles, rotary wing vehicles, hover crafts, and others. Further, the present inventions are contemplated for utilization in other applications that may not be coupled with an aircraft such as, for example, industrial applications, power generation, pumping sets, naval propulsion and other applications known to one of ordinary skill in the art.

Working fluid entering the gas turbine engine 50 is compressed by the compressor 52 and diffused through the diffuser 54 before being mixed with fuel and burned in the combustor 56. The compressor 52 can be an axial flow compressor or a centrifugal compressor. In one form the working fluid is air. The turbine 58 extracts energy from the combusted mixture of fuel and working fluid to provide useful work to drive the compressor 52, among other possible devices. The gas turbine engine 50 is depicted as a single spool, turbojet engine in the illustrative embodiment, but other types of gas turbine engines are contemplated for use in other embodiments.

Figure 2:
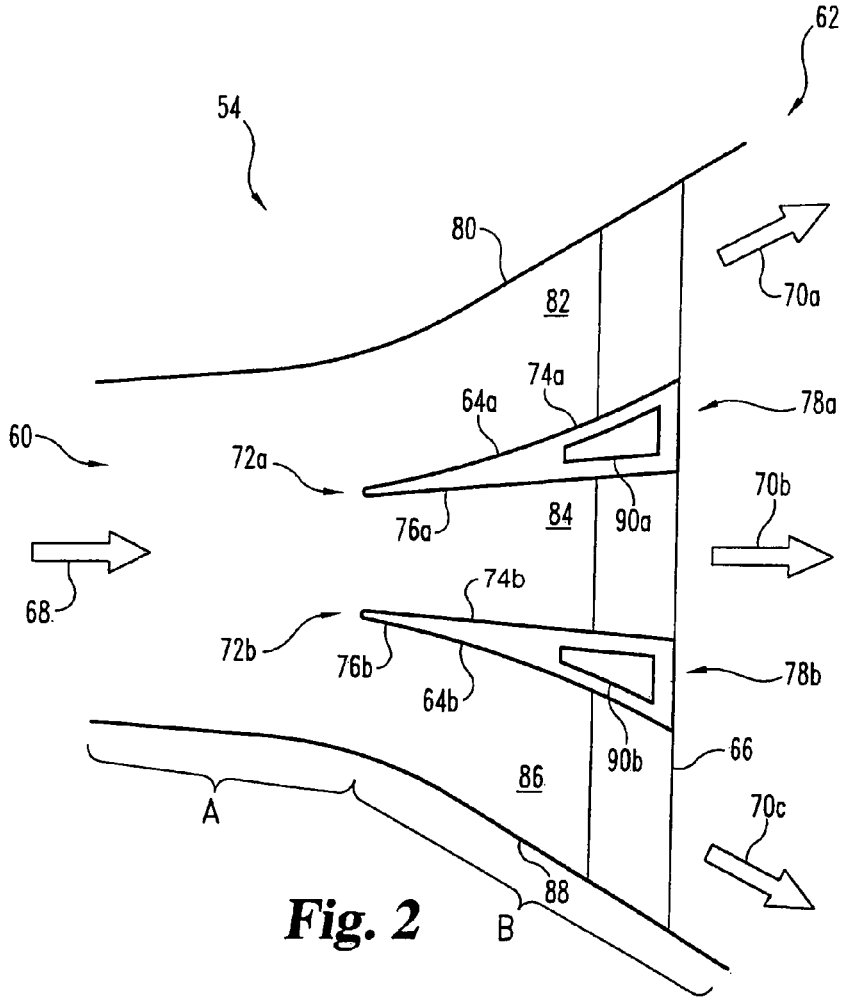
FIG. 2 is a side view of one embodiment of splitters disposed in a diffuser.

Turning now to FIG. 2, a side view of one embodiment of the diffuser 54 is shown. The diffuser includes an upstream end 60, a downstream end 62, splitters 64*a* and 64*b*, splitter supports 90*a* and 90*b*, and a diffuser strut 66. In some embodiments, however, the diffuser 54 may not include the splitters 64*a* and 64*b* and/or the splitter supports 90*a* and 90*b*. In some embodiments, furthermore, the splitters 64*a* and 64*b* and splitter supports 90*a* and 90*b* can be used in locations other than the diffuser 54. The upstream end 60 receives compressed flow 68 of working fluid from the compressor 52. In some embodiments, the compressed flow 68 originates from a compressor discharge of the compressor 52. In other embodiments, the compressed flow 68 can originate from other locations, such as a mid-stage of the compressor 52, to set forth just one non-limiting example.

The downstream end 62 provides three streams 70*a*, 70*b*, and 70*c* of diffused flow to the combustor 56. In some embodiments, the diffuser 54 can provide greater than three streams, or less than three streams, depending on the numbers and relative arrangements of splitters that may be used.

In certain embodiments, the splitters 64*a* and 64*b* are disposed within the diffuser 54 and serve to split the compressed flow 68 into the three separate streams 70*a*, 70*b*, and 70*c*. In some embodiments, the splitters 64*a* and 64*b* can be used in locations other than in diffusers, such as a duct or passageway that does not provide for a diffusion of a flow of working fluid. The splitters 64*a* and 64*b* each have, respectively, ends 72*a* and 72*b*, upper surfaces 74*a* and 74*b*, lower surfaces 76*a* and 76*b*, and trailing ends 78*a* and 78*b*. The splitters 64*a* and 64*b* may or may not be identical. Each of the splitters 64*a* and 64*b* are depicted as having a triangular-like wedge shape, but other shapes are also contemplated herein. For example, the splitters 64*a* and 64*b* can have any number of sides and/or surfaces necessary to split and/or diffuse the compressed flow 68.

The upper surface 74*a* of the splitter 64*a* is curved from the leading end 72*a* to the trailing end 78*a*. In some embodiments, however, the upper surface 74*a* can be non-curved or flat as seen in cross section like in FIG. 2, or can be non-curved or flat across the span of the splitter 64*a*. Furthermore, the upper surface 74*a* can be smooth or textured depending on the application. The curved nature of the upper surface 74*a* acts to direct the compressed flow 68 after it is split to form the stream 70*a*. Furthermore, the upper surface 74*a* and the diffuser upper surface 80 form a channel 82 that provides for an increase in cross sectional area generally between the leading end 72*a* and the trailing end 78*a*.

The channel 82 can have a generally increasing cross sectional area according to any relationship, such as linear or exponential, as would be appropriate for a desired application. In some embodiments, the channel 82 or portions thereof may not increase in cross sectional area. In some portions the channels 82 may decrease in cross sectional area.

The lower surface 76*a* is generally flat from the leading end 72*a* to the trailing end 78*a*. Some embodiments, however, can have a non-flat lower surface 76*a*. For example, the lower surface 76*a* can be curved or have an otherwise simple or complex shape depending on the particular application. Furthermore, the lower surface 76*a* can be smooth or textured depending on the application.

Like the lower surface 76*a*, the upper surface 74*b* of the splitter 64*b* is generally flat from the leading end 72*b* to the trailing end 78*b*. Some embodiments, however, can have a non-flat upper surface 74*b*. For example, the upper surface 74*b* can be curved or have an otherwise simple or complex shape depending on the particular application. Furthermore, the upper surface 74*b* can be smooth or textured depending on the application. The surfaces 76*a* and 74*b* need not be identical.

A channel 84 is formed by the lower surface 76*a* and the upper surface 74*b*. The channel 84 provides for an increase in cross sectional area along its length generally between one or both of the leading ends 72*a* and 72*b* and one or both of the trailing ends 78*a* and 78*b*. The increase in cross sectional area provides for a diffusion of the compressed flow 68 after it has been split to form the stream 70*b*. The channel 84 can have a generally increasing cross sectional area according to any relationship, such as linear or exponential, as would be appropriate for a desired application. In some embodiments, the channel 84 may not increase in cross sectional area, or may include a portion that does not increase in cross sectional area.

The lower surface 76*b* of the splitter 64*b* is curved from the leading end 72*b* to the trailing end 78*b*. In some embodiments, however, the lower surface 76*b* can be non-curved or flat as seen in cross section like in FIG. 2, or can be non-curved or flat across the span of the splitter 64*b*. Furthermore, the lower surface 76*b* can be smooth or textured depending on the application. The lower surface 76*b* acts to direct the compressed flow 68 after it is split to form the stream 70*c*. Furthermore, the lower surface 74*b*, in conjunction with diffuser lower surface 88, defines a channel 86 that provides for an increase in cross sectional area generally between the leading end 72*b* and the trailing end 78*b*.

The channel 86 can have a generally increasing cross sectional area according to any relationship, such as linear or exponential, as would be appropriate for any given application. In some embodiments, the channel may not increase in cross sectional shape, or may include a section that does not increase in cross sectional shape.

In the side view of FIG. 2, the splitters 64*a* and 64*b* are similar in shape but different in orientation. In particular, the splitters 64*a* and 64*b* are depicted as mirror images of each other. For example, the upper surface 74*a* of the splitter 64*a* is similar to the lower surface 76*b* of the splitter 64*b*. Likewise, the lower surface 76*a* of the splitter 64*a* is similar to the upper surface 74*b* of the splitter 64*b*. Although the splitters 64*a* and 64*b* in the illustrative embodiment have similar, mirror-opposite cross sectional shapes as depicted in FIG. 2, the splitters 64*a* and 64*b* can have dissimilar shapes in other embodiments. Furthermore, and as will be described further hereinbelow, the circumferential lengths of the splitters 64*a* and 64*b* can be different.

The locations of the splitters 64*a* and 64*b* need not be coincident. In particular, the leading ends 72*a* and 72*b* and the trailing ends 78*a* and 78*b* need not be at the same axial location. For example, the leading end 72*a* can be axially forward, or axially aft, of the leading end 72*b*. Likewise, the trailing end 78*a* can be axially forward, or axially aft, of the trailing end 78*b*. Other variations in the locations of the splitters 64*a* and 64*b* are also contemplated herein.

The compressed flow 68 that enters the diffuser 54 can be diffused in either or both of portions A and B. Some embodiments may not provide for a diffusion of the compressed flow in either portion A or B, but that the compressed flow is nonetheless split using one or more splitters. Portion A includes the area between the upstream end 60 of the diffuser 54 and either or both of the leading ends 72*a* and/or 72*b*. Some embodiments may not include a portion A. Portion B includes the area between either or both of the leading ends 72*a* and 72*b* and the downstream end 62. Some embodiments of portion B may terminate at one or both of the trailing ends 78*a* and 78*b*. Other embodiments of portion B can terminate at distances offset from the trailing ends 78*a* and 78*b*.

In one form, the diffuser strut 66 resides at a downstream location in the diffuser 54 and extends from the upper surface 80 to the lower surface 88. The diffuser strut 66 provides a structure that is coupled to the splitters 64*a* and 64*b*. In some embodiments, the diffuser strut 66 may reside at another stream location and, furthermore, may only partially extend between the upper surface 80 and the lower surface 88. In one non-limiting example, the diffuser strut 66 can be cantilevered from the upper surface 80.

The splitter supports 90*a* and 90*b* couple the splitters 64*a* and 64*b* to the diffuser strut 66. In one form the splitter supports 90*a* and 90*b* are received within cavities defined within the splitters 64*a* and 64*b* in the illustrative embodiment as will be described further hereinbelow. Further details of the splitter supports 90*a* and 90*b* are also provided hereinbelow.

Figure 3B:
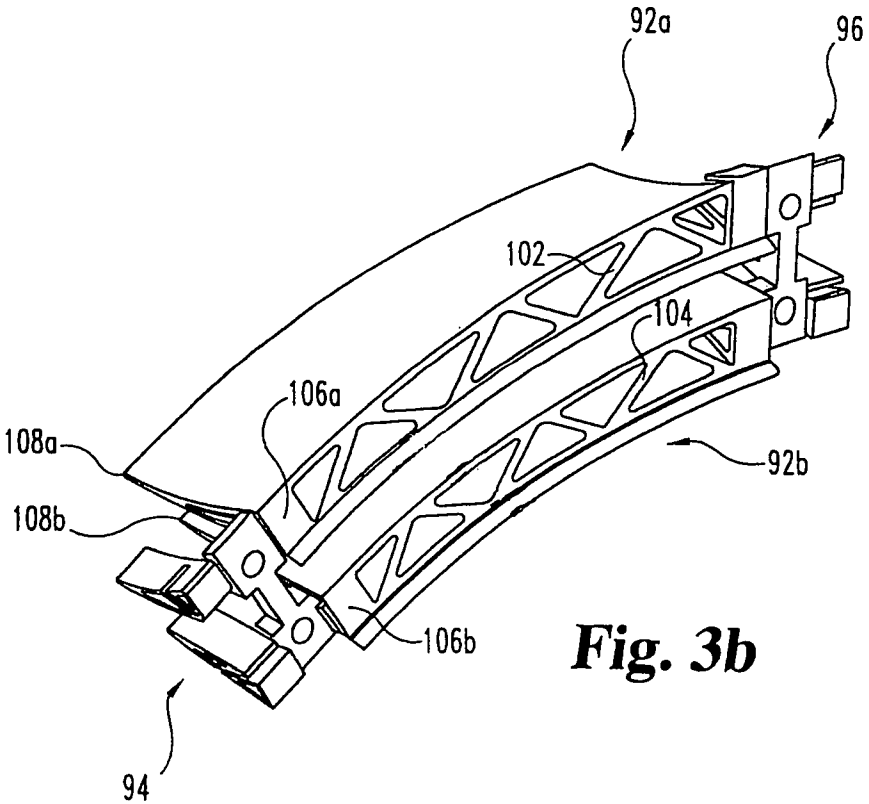
FIG. 3*b* is a perspective view of one embodiment of splitters coupled with splitter supports.
Figure 3A:
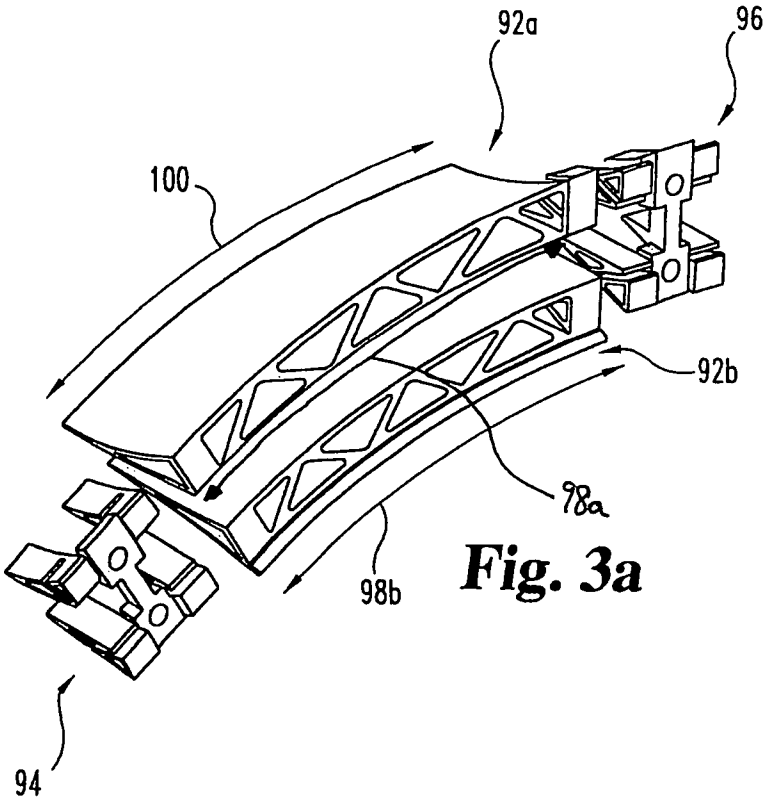
FIG. 3*a* is a perspective view of one embodiment of splitters and splitter supports.

Turning now to FIGS. 3*a* and 3*b*, a perspective view is shown of flow splitters 92*a* and 92*b* as well as the splitter supports 94 and 96. The splitter supports 94 and 96 are depicted as uncoupled from the flow splitters 92*a* and 92*b* in FIG. 3*a*. FIG. 3*b* depicts the splitter supports 94 and 96 coupled to the flow splitters 92*a* and 92*b*. The splitter supports 94 and 96 are slidingly received within the flow splitters 92*a* and 92*b* in the illustrative embodiment, but in other embodiments the flow splitters 92*a* and 92*b* can be slidingly received within the splitter supports 94 and 96. Further details of the interface between the flow splitters and the splitter supports will be described further hereinbelow.

The flow splitters 92*a* and 92*b* in the illustrative embodiment are curved along an elongate direction 100 and have lengths 98*a* and 98*b*. The elongate direction 100 in the illustrative embodiment is circumferential as would be the case if the flow splitters 92*a* and 92*b* were disposed in an annulus of an axial gas turbine engine. In one non-limiting example, the flow splitters 92*a* and 92*b* are formed as arcs of a circle. Other embodiments can have an elongate direction 100 that is primarily linear, in which case the lengths 98*a* and 98*b* would be primarily linear as opposed to circumferential. Other elongate directions are also possible. Each of the flow splitters 92*a* and 92*b* have different lengths 98*a* and 98*b*, owing in part to an annulus area in which the flow splitters 92*a* and 92*b* are disposed. However, some embodiments can include the flow splitters 92*a* and 92*b* having substantially equal lengths 98*a* and 98*b*.

The flow splitters 92*a* and 92*b* have cross members 102 and 104 defined in trailing ends 106*a* and 106*b*. The cross members 102 and 104 can have a variety of lengths and widths and can furthermore be arranged in any orientation. For example, the cross members 102 and 104 can have a width that extends towards leading ends 108*a* and 108*b* of the flow splitters 92*a* and 92*b*. The cross members 102 and 104 are arranged to form a sawtooth-like shape, but other arrangements are also contemplated herein. For example, a plurality of cross members 102 can be alternatively arranged parallel to one another in the trailing end 106*a* of the flow splitter 92*a*. In another example, the cross members 104 can be formed as a lattice network of crisscrossing members. Though the cross members 102 and 104 are shown as similar in size and arrangement, other embodiments can include cross members having different sizes, shapes, and arrangements. Some embodiments of the flow splitters may lack such cross members.

Figure 4:
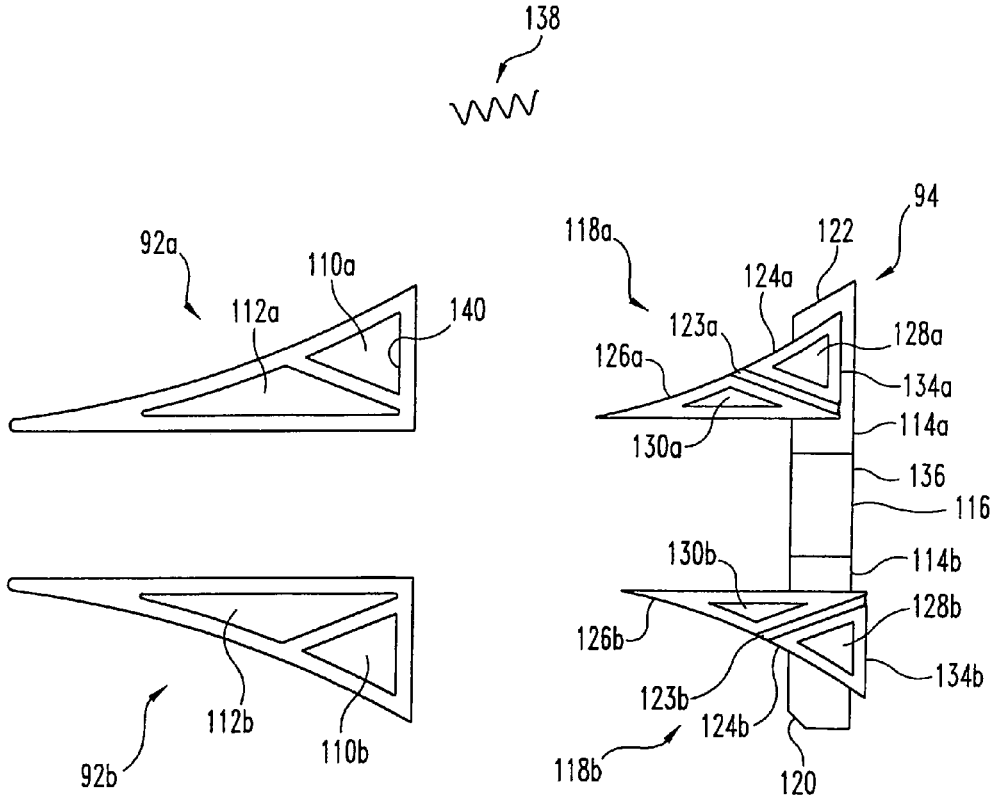
FIG. 4 is a side view of one embodiment of splitters and a splitter support.

Turning now to FIG. 4, a side view is depicted of the flow splitters 92*a* and 92*b* as well as the splitter support 94. The flow splitters 92*a* and 92*b* include recesses 110*a* and 112*a*, as well as recesses 110*b* and 112*b*, respectively. In addition, separator supports 114*a* and 114*b* are disposed between the recesses 110*a* and 112*a*, as well as the recesses 110*b* and 112*b*, respectively. Though the recesses 110*a* and 110*b* appear as mirror images of each other, as do the recesses 112*a* and 112*b*, some embodiments can include recesses having different shapes and sizes. In addition, though each splitter 92*a* and 92*b* is depicted as having two separate recesses, some embodiments may provide only a single recess for each splitter. Other embodiments can have more than two recesses. Still further, each of the flow splitters 92*a* and 92*b* can have a unique number of recesses.

The recesses 110*a*, 110*b*, 112*a*, and 112*b* are all depicted as triangular shaped in the illustrative embodiment. Other embodiments, however, can include recesses having a variety of shapes. For example, the recess 110*a* can be square in one embodiment while the recess 110*b* is circular. In another example, the recess 110*a* might be pentagonal while the recess 112*a* is in the shape of a rhombus. Other shapes are also contemplated herein. While only one end of the flow splitters 92*a* and 92*b* is depicted in FIG. 4, the other end of the flow splitters 92*a* and 92*b* can include shapes either the same or different to the ends depicted in FIG. 4. For example, a triangular-shaped recess can be included in one end of the flow splitters, while a square shaped recess can be formed in the other.

The splitter support 94 includes the separator supports 114*a* and 114*b*, a spine 116, and support arms 118*a* and 118*b*. The splitter support 94 can be designed such that the stiffness of the support arms 118*a* and 118*b* resists bending deflections of the splitter caused by radial variations of a flow of working fluid. The separator supports 114*a* and 114*b* can have a variety of widths and heights, and furthermore the separator supports 114*a* and 114*b* need not be identical. Some embodiments, furthermore, can include one or more of the separator supports 114*a* and 114*b* having a chamfered edge, such as that depicted as chamfered surface 120. The separator supports 114*a* and 114*b* need not have parallel edges as can be seen by a slanted edge 122. Various shapes and arrangements of the separator supports 114*a* and 114*b* are contemplated herein. The separator supports 114*a* and 114*b* are coupled via the spine 116 in the illustrative embodiment, but some embodiments may not include the spine 116 such that the separator supports 114*a* and 114*b* become an integrated, single base. Where no spine 116 is provided and instead the separator supports 114*a* and 114*b* are one integral support, the width and height of the integral support can vary. The spine 116 can have a variety of widths, heights, and shapes depending on any particular application.

The support arms 118*a* and 118*b* include arms 123*a* and 123*b*, as well as extensions 124*a*, 126*a*, and 124*b*, 126*b*. The arms 123*a* and 123*b* form a surface from which extend the extensions 124*a*, 126*a*, and 124*b*, 126*b*, respectively. The arms 123*a* and 123*b* themselves extend from the separator supports 114*a* and 114*b* and have relatively constant thickness. Some embodiments, however, can include the arms 123*a* and 123*b* having a variable thickness. Furthermore, the arms 123*a* and 123*b* need not be identical.

The extensions 124*a*, 126*a*, and 124*b*, 126*b* are triangular shaped in the illustrative embodiment and correspond to the recesses 110*a*, 112*a*, and 110*b* and 112*b*, respectively, in the flow splitters 92*a* and 92*b*. The shapes of the extensions are complementary to the shapes of the recesses to provide an interference fit between the support arms and the splitters. In some embodiments, however, the size and/or shape of one or more extensions can be different than the corresponding one or more support arms such that some amount of play may be present when the splitters are coupled to the splitter supports.

The support arms 118*a* and 118*b* include aft ends 134*a* and 134*b*, respectively. The aft ends 134*a* and 134*b* are relatively flat in the illustrative embodiment but can take on other forms in different embodiments. The aft ends 134*a* and 134*b* can be arranged at any angle relative to other structure in the splitter supports, such as the spine 116 to set forth just one non-limiting example. Furthermore, the aft ends 134*a* and 134*b* can be located at different flow locations, as can be seen in the illustrative embodiment relative to the spine 116: the aft end 134*a* of the support arm 118*a* is placed forward of the aft end 134*b* of the support arm 118*b*. Some embodiments, however, can include the support arms 118*a* and 118*b* having the aft ends 134*a* and 134*b* placed at the same flow location. In still further embodiments, the aft end 134*a* can be located further aft than the aft end 134*b*.

The extensions 124*a*, 126*a*, and 124*b*, 126*b* include cavities 128*a*, 130*a*, and 128*b*, 130*b*, respectively, though in some embodiments one or more of the extensions can be solid. In one embodiment, for example, the extension 124*a* might be solid while the extension 126*a* includes a cavity. Furthermore, the extensions of the support arms 118*a* to the support arm 118*b* might be different. To set forth just one non-limiting example, the extension 124*a* might include a cavity while the extension 124*b* might be solid. In sum, the extensions can be solid, can include a cavity, or can be a mixture thereof. Though both of the support arms 118*a* and 118*b* are depicted as each having two extensions, some embodiments may include only a single extension while other embodiments may include more than two extensions. In addition, each of the support arms 118*a* and 118*b* can have a unique number of extensions. To set forth one non-limiting example, the support arm 118*a* can have a single extension while the support arm 118*b* has two extensions.

In one form during installation, the support arms 118*a* and 118*b* can be received within the recesses of the flow splitters 92*a* and 92*b*. For example, the extensions 124*a* and 126*a* of the support arm 118*a* can be received within the recesses 110*a* and 112*a*, respectively. In some embodiments, the support arms 118*a* and 118*b* and the splitters 92*a* and 92*b* can form an interference fit such that little mechanical free-play is present in the coupling. Some embodiments, however, may have some amount of free-play. The splitter supports can be slidingly received with the splitter arms along the elongate direction 100 (shown in FIGS. 3*a* and 3*b*). Though the extensions 124*a* and 126*a* are received within the recesses 110*a* and 112*a*, some embodiments can include the flow splitter 92*a* having extensions that are received within the recesses of a corresponding support arm. Similar to the flow splitter 92*a* and the support arm 118*a*, the flow splitter 92*b* can have extensions and the support arm 118*b* can have recesses such that the flow splitter 92*b* is received within the support arm 118*b*.

Figure 7:
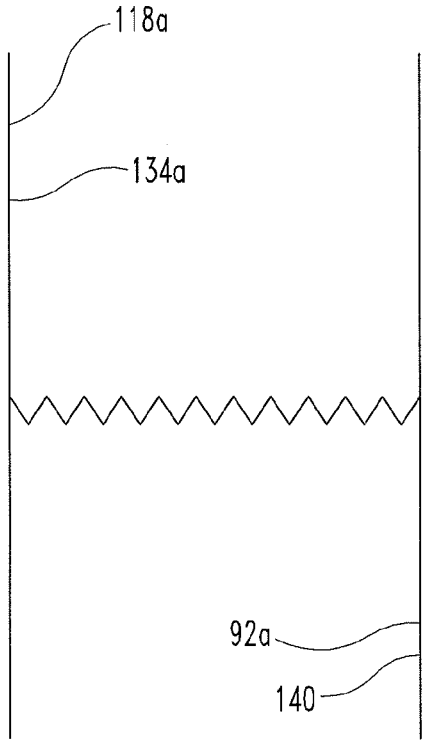
FIG. 7 depicts a location of a resilient member relative to a flow splitter and support arm.

In some embodiments, a resilient member 138 can be disposed between the flow splitter 92*a* and the support arm 118*a*. In one non-limiting example, the resilient member 138 can be disposed between a surface 140 of the flow splitter 92*a* and the aft end 134*a* of the support arm 118*a* when the splitter supports are coupled with the flow splitters (see, e.g., FIG. 7). In one form the resilient members can be a spring, elastomeric material, or other type of device/mechanism/material that compresses upon the application of force and provides an opposing force upon compressing. If formed as a spring, the resilient member can take the form of a helical coil spring, leaf spring, spiral spring, or a volute spring, to set forth just a few non-limiting examples. The resilient members 138 can be coupled between all of the flow splitters and splitter supports or only a subset. In addition, the resilient member 138 can be placed in other locations. The resilient 138 creates a force when compressed that ensures a positive contact between the flow splitters and the splitter supports and, in some embodiments, can ensure a maximum amount of contact and support.

Figure 5:
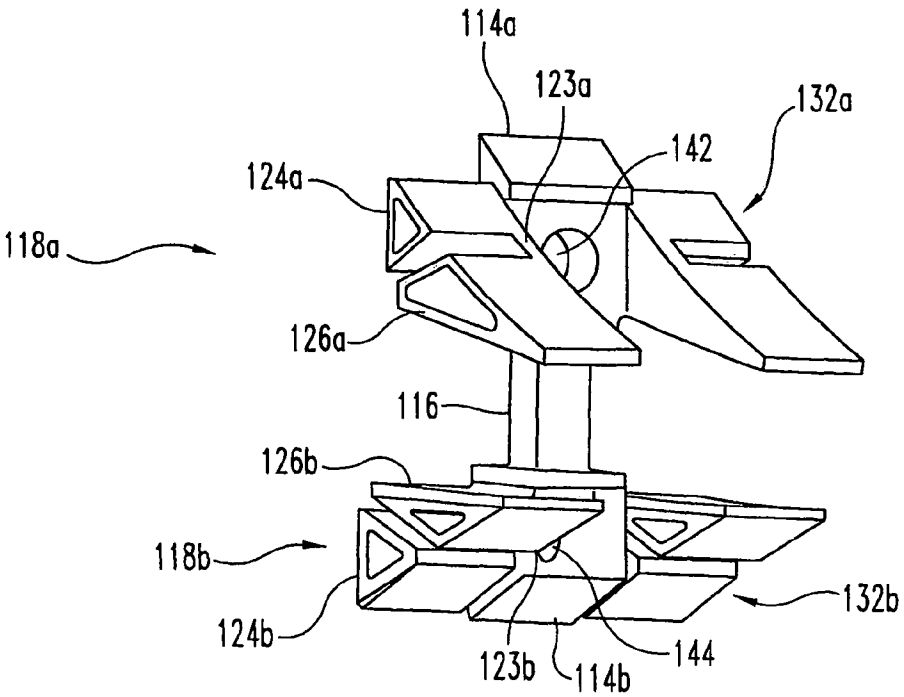
FIG. 5 is a perspective view of one embodiment of a splitter support.

Turning now to FIG. 5, a perspective view of one embodiment of the splitter support 94 is shown. In addition to various other features described herein, the splitter support 94 also includes apertures 142 and 144. The apertures 142 and 144 are used to couple the splitter support 94 to a structure within the gas turbine engine 50. For example, the apertures 142 and 144 can be used to permit the splitter support 94 to be releasably fastened to a diffuser strut (not shown), to set forth just one non-limiting embodiment. In some embodiments, the apertures 142 and 144 may not be needed if, for example, the splitter support 94 is coupled with the gas turbine engine 50 using techniques such as welding, brazing, or gluing, among potential others. In addition, the apertures 142 and 144 may not be needed if the splitter support 94 is integrally formed with other structures in the gas turbine engine 50.

It will be understood that while the splitter support 94 includes the support arms extending from both sides, each support arm can be unique. For example, the support arm 118*a* can be different than the support arm 118*b*, just as the support arm 118*a* can be different from a support arm 132*a*. Likewise, the support arm 132*a* can be different than a support arm 132*b*, just as the support arm 118*b* can be different from a support arm 132*b*.

Figure 6:
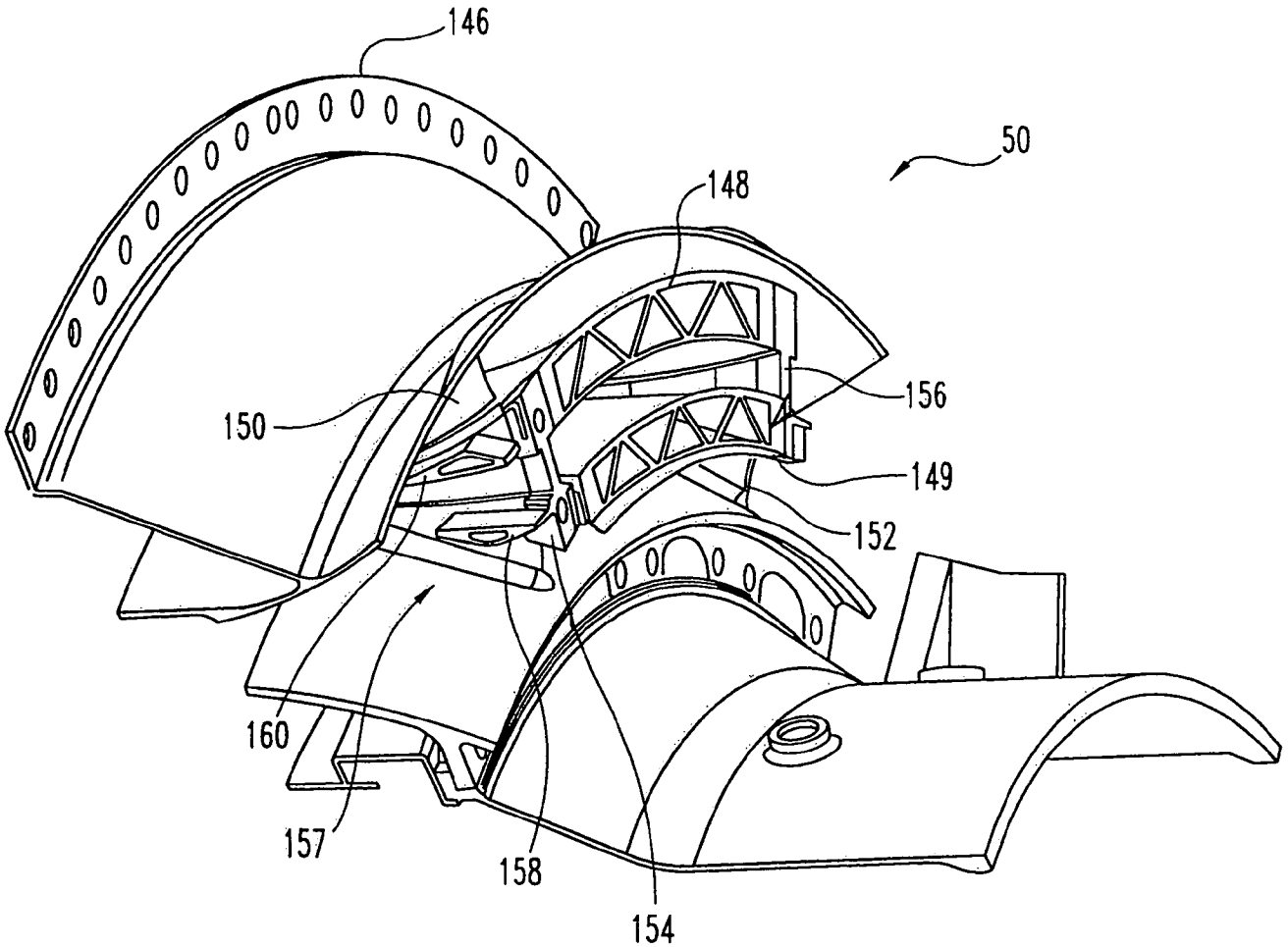
FIG. 6 is a partial perspective view of a gas turbine engine diffuser having an embodiment of splitters disposed within.

Turning now to FIG. 6, a partial cut away view of the gas turbine engine 50 is shown. A diffuser 146 is provided within which is disposed splitters 148 and 149. The splitters 148 and 149 are coupled to diffuser struts 150 and 152 via splitter supports 154 and 156. As can be seen, the embodiment of the splitter support 154 includes a support arm 157 having only a single extension 158 and 160 for corresponding splitters. The splitters 148 and 149 occupy only a portion of the annulus around the axial flow path through the gas turbine engine 50. Although two splitters 148 and 149 are shown in the embodiment of FIG. 6, other embodiments can have a single splitter. Still further embodiments can include more than one splitter. As will be appreciated, other splitters and splitter supports can also be used in the remaining portions of the annulus such that an annular array of splitters is provided.

One aspect of the present application includes a splitter and a splitter support that can be used within a diffuser of a gas turbine engine. The splitter is elongate and can include a curvature so that it can be used within a portion of an annulus of an axial gas turbine engine. The splitter further includes apertures useful to receive support arms of the splitter support. The splitter support can be attached to a diffuser strut. Multiple splitters and splitter supports can be used within the gas turbine engine.

Another aspect of the present application includes an apparatus comprising a gas turbine engine having a compressor, a flow splitter disposed within the gas turbine engine and having upper and lower surfaces for splitting a flow of working fluid from the compressor, the flow splitter also having ends operable to be connected to the gas turbine engine and a fastener assembly used to connect the ends of the flow splitter to the gas turbine engine, the fastener assembly including a protrusion operable to be translatingly received within an aperture.

Yet another aspect of the present inventions includes an apparatus comprising a gas turbine engine flow splitter having a semi-annular shape and mount points that are operable to be slidably engageable with a structure within a gas turbine engine, the flow splitter operable to split a flow of working fluid within the gas turbine engine.

A further aspect of the present invention includes an apparatus comprising a flow splitter operable downstream of an axial compressor within a gas turbine engine and means for coupling the flow splitter to the gas turbine engine.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas turbine engine having a compressor;

a flow splitter disposed within a flow path between a radially inner wall and radially outer wall of the gas turbine engine and having upper and lower surfaces for splitting a flow of working fluid from the compressor, the flow splitter also having fastener portions disposed on opposing circumferential ends operable to be connected to the gas turbine engine;

a radially oriented splitter support structured to be coupled to and support the flow splitter;

a fastener assembly used to connect the opposing circumferential ends of the flow splitter to the radially oriented splitter support of the gas turbine engine, the fastener assembly operable by way of a protrusion in one of the flow splitter and splitter support, the protrusion oriented in a circumferential direction translatingly received within an aperture of the other of the flow splitter and splitter support, the aperture oriented in a circumferential direction; and a diffuser located downstream of the compressor and upstream from a combustor, wherein the flow splitter is disposed within the diffuser.

2. The apparatus of claim 1, wherein the flow splitter is disposed within the diffuser, and wherein the compressor is an axial flow compressor.

3. The apparatus of claim 2, wherein the fastener assembly is a splitter support having the protrusion, wherein the flow splitter includes the aperture.

4. The apparatus of claim 3, wherein the splitter support is coupled with a diffuser strut located in the diffuser.

5. The apparatus of claim 4, wherein the splitter support is attached to a trailing edge of the diffuser struts.

6. The apparatus of claim 3, wherein the splitter support includes a base, wherein the protrusion extends away from the base.

7. The apparatus of claim 3, wherein the protrusion is a first protrusion, and wherein the splitter support includes a second protrusion, the first protrusion and the second protrusion operable to support the flow splitter and a second splitter.

8. The apparatus of claim 7, wherein the first protrusion and the second protrusion each include two extensions that extend from two arms.

9. The apparatus of claim 1, wherein the fastener assembly further includes a resilient member.

10. The apparatus of claim 1, which further includes a plurality of splitters disposed circumferentially around an annulus of the gas turbine engine.

11. An apparatus comprising:

a gas turbine engine flow splitter having a semi-annular shape that extends between a first arc end and a second arc end and mount points disposed at the first arc end and the second arc end that are operable to be circumferentially slidably engageable with a support within a gas turbine engine, the flow splitter operable to split a flow of working fluid within the gas turbine engine, the support oriented radially and having a support mount point that is complementary to the first arc end mount point of the gas turbine engine flow splitter, the support mount point structured to be circumferentially slidably engageable with the first arc end mount point of the flow splitter, wherein one of the support mount point and the first arc end mount point of the splitter is configured as a protrusion, and the other of the support mount point and the first arc end mount point of the splitter is configured as an aperture that receives the protrusion; and wherein the gas turbine engine flow splitter is located downstream of a compressor and upstream of a combustor.

12. The apparatus of claim 11, which further includes a gas turbine engine having the gas turbine engine flow splitter and wherein the compressor is an axial flow compressor.

13. The apparatus of claim 12, wherein the gas turbine engine flow splitter is operable to split a flow of working fluid into a plurality of streams.

14. The apparatus of claim 13, wherein the plurality of streams pass through channels formed in part by the flow splitter, the channels providing a diffusion to the plurality of streams.

15. The apparatus of claim 11, wherein the mount points includes a first mount point formed as an opening operable to receive the structure.

16. The apparatus of claim 11, wherein the gas turbine engine flow splitter includes a top surface, a bottom surface, and a blunt base, the blunt base located on a downstream side of the gas turbine engine flow splitter.

17. The apparatus of claim 16, wherein the blunt base includes a cross member operable to couple the top surface to the bottom surface.

18. The apparatus of claim 11, wherein the support includes an extension operable to engage the flow splitter.

19. The apparatus of claim 18, wherein the flow splitter includes an aperture having a complementary shape of the extension in the support.

* * * * *